United States Patent [19]

Begley

[11] Patent Number: 4,564,577

[45] Date of Patent: Jan. 14, 1986

[54] NAPHTHOQUINONE REDOX DYE-RELEASERS

[75] Inventor: William J. Begley, Webster, N.Y.

[73] Assignee: Eastman Kodak Company, Rochester, N.Y.

[21] Appl. No.: 733,151

[22] Filed: May 13, 1985

[51] Int. Cl.[4] ..... G03C 1/40; G03C 5/54

[52] U.S. Cl. ..... 430/223; 430/559; 430/562

[58] Field of Search ..... 430/223, 559, 562

[56] References Cited

U.S. PATENT DOCUMENTS 4,139,379 2/1979 Chasman et al. ..... 430/223

4,232,107 11/1980 Janssens ..... 430/223

*Primary Examiner*—Richard L. Schilling

*Attorney, Agent, or Firm*—Harold E. Cole

[57] ABSTRACT

Photographic elements and diffusion transfer assemblages are described which employ a nondiffusible, positive-working, redox dye-releaser having the formula:

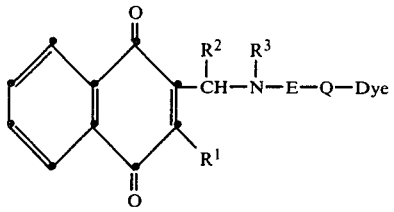

wherein:

(a) $R^1$ represents a substituted or unsubstituted alkyl group of from 1 to about 30 carbon atoms or a substituted or unsubstituted aryl group of from 6 to about 12 carbon atoms, (b) $R^2$ and $R^3$ each independently represents hydrogen or $R^1$;

(c) E represents carbonyl or thiocarbonyl;

(d) Q represents a nonmetallic atom of Group VA or VIA of the periodic table in its minus 2 or minus 3 valence state; and (e) Dye represents a diffusible dye moiety or precursor thereof;

with the proviso that at least one of $R^1$, $R^2$ and $R^3$ is an organic ballasting radical of such molecular size and configuration as to render the compound nondiffusible in a photographic element during development in an alkaline processing composition.

26 Claims, No Drawings

NAPHTHOQUINONE REDOX DYE-RELEASERS

This invention relates to photography, and more particularly to photographic elements and assemblages for color diffusion transfer photography employing at least one silver halide emulsion layer and a novel naphthoquinone, positive-working, redox dye-releaser (PRDR).

Various formats for color, integral transfer elements are described in the prior art, such as U.S. Pat. Nos. 3,415,644; 3,415,645; 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages employing nondiffusible PRDRs, a dye is released as an inverse function of development, i.e., dye is released by some mechanism in the non-exposed areas of the silver halide emulsion. Use of a negative-working silver halide emulsion in such a system will therefore produce a positive image in the image-receiving layer. Examples of such PRDRs are described in U.S. Pat. Nos. 4,139,379 and 4,139,389. The immobile compounds described in these patents are ballasted electron-accepting nucleophilic displacement (BEND) compounds. The BEND compound as incorporated in a photographic element is substantially incapable of releasing a diffusible dye. However, during photographic processing under alkaline conditions, the BEND compound is capable of accepting at least one electron (i.e. being reduced) from an incorporated reducing agent (IRA) and thereafter releases a diffusible dye. This occurs in the unexposed areas of the emulsion layer. In the exposed areas of the emulsion layer, however, an electron transfer agent (ETA) reduces the silver halide and becomes oxidized. The oxidized ETA is then reduced by the IRA, thus preventing the IRA from reacting with the BEND compound. The BEND compound therefore is not substantially reduced and thus no dye is released in the exposed areas.

After processing the photographic element described above, the electron transfer agent remains after imaging in both the exposed and nonexposed areas. A problem which occurs is that the D-min continues to increase over a period of time. This is sometimes described in the art as "post-process density increase". It is believed that over a period of time, the electron transfer agent can slowly reduce the PRDR and cause this unwanted dye release. It would be desirable to find a way to reduce this post-process density increase to provide a better photographic image.

U.S. Pat. No. 4,139,379 of Chasman et al describes various PRDRs including certain quinone compounds. In column 11, there is a description that 5-to-7 membered rings may be fused to the benzene ring structure in column 10. The only specific example of this is illustrated in column 35, which is a bridged ring fused to a quinone nucleus. In column 36 are listed various benzoquinone structures which are preferred because they contain two releasable dye moieties on each quinone nucleus.

The benzoquinone compounds of Chasman et al are difficult to synthesize and do not have as great a reactivity as would be desired. As will be shown by the comparative tests hereinafter, the naphthoquinone PRDR compounds of the invention have a greater reactivity and a reduced "post-process density increase" than the corresponding benzoquinone compounds of Chasman et al. The enhanced photographic activity of the naphthoquinone PRDRs was unexpected because naphthoquinones have been regarded as substantially more difficult to reduce than benzoquinones. Fieser and Fieser (Advanced Organic Chemistry; N.Y., Reinhold, 1961, pp. 847–851) have published the reduction potential, Eo (aq.) of benzoquinone and naphthoquinone as 0.699 and 0.470 V, respectively (the more positive, the more readily reduced).

U.S. Pat. No. 4,232,107 of Janssens relates to quinone-type compounds which are capable of releasing a photographically useful group such as a dye. While a naphthoquinone compound is described in columns 20 and 21, the release structure mechanism is different from the compounds of the invention. In Janssens, the dye is released from an o-quinonemethide as a sulfinate by a 1,4-elimination reaction. In using the compounds of this invention, dyes are released by a nucleophilic displacement reaction, as described by Chasman et al above.

A photographic element in accordance with the invention comprises a support having thereon at least one photosensitive silver halide emulsion layer having associated therewith a nondiffusible, positive-working, redox dye-releaser compound capable of releasing at least one diffusible dye moiety, the compound having the formula:

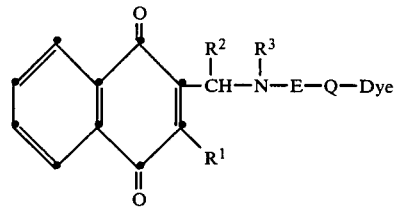

wherein:

(a) $R^1$ represents a substituted or unsubstituted alkyl group of from 1 to about 30 carbon atoms or a substituted or unsubstituted aryl group of from 6 to about 12 carbon atoms, (b) $R^2$ and $R^3$ each independently represents hydrogen or $R^1$;

(c) E represents carbonyl or thiocarbonyl;

(d) Q represents a nonmetallic atom of Group VA or VIA of the periodic table in its minus 2 or minus 3 valence state; and (e) Dye represents a diffusible dye moiety or precursor thereof;

with the proviso that at least one of $R^1$, $R^2$ and $R^3$ is an organic ballasting radical of such molecular size and configuration as to render the compound nondiffusible in the photographic element during development in an alkaline processing composition.

In a preferred embodiment of the invention, $R^1$ in the above formula is the ballasting radical and $R^3$ is aryl. For example, $R^1$ may be a substituted or unsubstituted alkyl group of at least about 12 carbon atoms such as $C_{15}H_{31}$, $C_{16}H_{33}$, $C_{12}H_{25}$, $CH_3CHC_{10}H_{21}$, $C_{15}H_{30}Cl$, or $C_{12}H_{24}OC_2H_5$; and $R^3$ may be aryl such as phenyl, p-$C_6H_4CH_3$, o-$C_6H_4OCH_3$ or p-$C_6H_4OC_2H_5$, with phenyl being especially preferred.

In another preferred embodiment, Q in the above formula may be nitrogen, oxygen, sulfur or selenium, with oxygen being especially preferred.

In yet another preferred embodiment of the invention, $R^2$ in the above formula is hydrogen and E is carbonyl.

In still another preferred embodiment of the invention, the silver halide emulsions employed are the conventional, negative-working emulsions well known to those skilled in the art. A positive image will thereby be obtained in the image-receiving layer. Use of a direct-positive emulsion will produce a negative image in the image-receiving layer. Such a negative can be used to produce positive prints if so desired.

When a negative-working silver halide emulsion is employed, there is preferably employed with it an incorporated reducing agent for imagewise reducing the quinone to the corresponding hydroquinone. These compounds are well known to those skilled in the art as shown, for example, by U.S. Pat. Nos. 4,278,750, 4,263,393, 4,360,581 and 4,366,240, the disclosures of which are hereby incorporated by reference.

In the above formula, Dye can be any dye moiety or precursor thereof as long as it is diffusible. Dyes which can be employed include, for example, azo, azomethine, azopyrazolone, indoaniline, indophenol, anthraquinone, triarylmethane, alizarin, merocyanine, nitro, quinoline, cyanine, imidazole, phthalocyanine, etc. In some embodiments of the invention, the dye moiety may contain a blocking group. In a preferred embodiment of the invention, azo dyes are employed. The above dyes may also be pre-metallized or post-metallized, if desired. Examples of such dyes are disclosed, for example, in U.S. Pat. Nos. 4,481,141 of Evans, 4,476,207 of Elwood et al, 4,426,326 of Bailey et al, 4,436,799 of Evans et al, 4,396,546 of Krutak et al, 4,368,249 of Anderson et al and 4,248,956 of Baigrie et al, the disclosures of which are hereby incorporated by reference.

Use of the naphthoquinone PRDR compounds of the invention provides many advantages. One such advantage is that the dye release rate for these compounds is faster than the corresponding benzoquinone analogues. Another advantage is that the post-process density increase of the naphthoquinone PRDRs, i.e., their propensity to release additional unwanted dye after processing, is substantially improved over the benzoquinone analogues of otherwise comparable reactivity.

In preparing the naphthoquinone PRDRs of the invention as compared to the corresponding benzoquinones, the yields of the synthetic steps are generally better and the isolation and purification of the products is notably easier, particularly in the isolation of the final PRDRs without resorting to chromatographic techniques. Also, there is a wide choice of feasible synthetic routes for PRDR compounds of the above formula in which $R^3$ is aryl. These PRDRs are more photographically reactive for dye release than the analogues in which $R^3$ is alkyl. This greater reactivity permits reaction with certain weakly nucleophilic groups on dye molecules not heretofore possible. Such dyes can be "chromophore-linked" to the imaging moiety. Dyes thus "chromophore-linked" are shifted from their normal absorption spectra, which is an advantage since an additional blocking group would not be necessary to achieve this. Such "shifted" PRDRs could then be incorporated directly into a silver halide emulsion layer without adversely affecting its speed and eliminate the need for coating additional layers.

Other substituents may also be present in the naphthoquinone ring illustrated above, such as alkyl of 1 to 6 carbon atoms, acyl, aryl of 6 to 10 carbon atoms, aralkyl, alkylsulfonyl, amino, alkoxy, halogens such as chloro or bromo, morpholino, phenylsulfamoyl, solubilizing groups such as sulfonamido, sulfamoyl, carboxy, sulfo or hydrolyzable precursors thereof.

The photographic element described above can be treated in any manner with an alkaline processing composition to effect or initiate development. A preferred method for applying processing composition is by use of a rupturable container or pod which contains the composition. In general, the processing composition employed in this invention contains the developing agent for development, although the composition could also just be an alkaline solution where the developer is incorporated in the photographic element or cover sheet, in which case the alkaline solution serves to activate the incorporated developer.

A photographic film unit or assemblage in accordance with this invention is adapted to be processed by an alkaline processing composition, and comprises:

(1) a photographic element as described above; and (2) a dye image-receiving layer.

In this embodiment, the processing composition may be inserted into the film unit, such as by interjecting processing solution with communicating members similar to hypodermic syringes which are attached either to a camera or camera cartridge. The processing composition can also be applied by means of a swab or by dipping in a bath, if so desired. Another method of applying processing composition in a film assemblage which can be used in our invention is the liquid spreading means described in Columbus U.S. Pat. No. 4,370,407, issued Jan. 25, 1983.

In a preferred embodiment of the invention, the assemblage itself contains the alkaline processing composition and means containing same for discharge within the film unit. There can be employed, for example, a rupturable container which is adapted to be positioned during processing of the film unit so that a compressive force applied to the container by pressure-applying members, such as would be found in a camera designed for in-camera processing, will effect a discharge of the container's contents within the film unit.

The dye image-receiving layer in the above-described film assemblage is optionally located on a separate support adapted to be superposed on the photographic element after exposure thereof. Such image-receiving elements are generally disclosed, for example, in U.S.

Pat. No. 3,362,819. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above-described film assemblage in another embodiment is located integrally with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer and dye images are formed as a function of development which diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is useful is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container containing an alkaline processing composition and an opacifier is positioned adjacent the top layer and a transparent top sheet which has thereon a neutralizing layer and a timing layer. The film unit is placed in a camera, exposed through the transparent top sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images are formed as a result of development which diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also preferably contains a neutralizing layer and a timing layer underneath the dye image-receiving layer.

In another embodiment of the invention, the neutralizing layer and timing layer are located underneath the photosensitive layer or layers. In that embodiment, the photographic element would comprise a support having thereon, in sequence, a neutralizing layer, a timing layer and at least one photosensitive silver halide emulsion layer having associated therewith a dye image-providing material. A dye image-receiving layer would be provided on a second support with the processing composition being applied therebetween. This format could either be peel-apart or integral, as described above.

A process for producing a photographic transfer image in color according to the invention from an imagewise exposed photosensitive element comprising a support having thereon at least one photosensitive silver halide emulsion layer having associated therewith a dye image-providing material as described above comprises treating the element with an alkaline processing composition in the presence of a silver halide developing agent or ETA to effect development of each of the exposed silver halide emulsion layers. An imagewise distribution of dye image-providing material is thus formed as a function of development, and at least a portion of it diffuses to a dye image-receiving layer to provide the transfer image.

A preferred photographic assemblage in accordance with the invention comprises:

(a) a photographic element comprising a support having thereon the following layers in sequence: a dye image-receiving layer, a stripping layer, a substantially opaque layer and a photosensitive silver halide emulsion layer having associated therewith a dye image-providing material as described above;

(b) a transparent cover sheet superposed over the silver halide emulsion layer; and (c) an opaque alkaline processing composition and means containing same for discharge, during processing, between the cover sheet and the photosensitive element.

Any material may be employed as the stripping layer in the assemblage described above provided it will perform the desired function of stripping cleanly. Such material are disclosed, for example, in U.S. Pat. Nos. 3,220,835, 3,730,718 and 3,820,999 and include gum arabic, sodium alginate, pectin, polyvinyl alcohol and hydroxyethyl cellulose. In a preferred embodiment of this invention, hydroxyethyl cellulose is employed as the stripping layer.

The stripping layer materials employed in the assemblage described above can be employed in any amount which is effective for the intended purpose. In general, good results have been obtained at a concentration of from about 5 to about 2000 $mg/m^2$ of element. The particular amount to be employed will vary, of course, depending on the particular stripping layer material employed and the nature of the other layers of the diffusion transfer element.

The film unit or assembly of the present invention is used to produce positive images in single- or multicolors. Elements for producing a monochromatic dye image in which the present invention is useful are described in U.S. Pat. No. 4,485,165 issued Nov. 27, 1984, the disclosure of which is hereby incorporated by reference. In a three-color system, each silver halide emulsion layer of the film assembly will have associated therewith a dye-releasing compound which releases a dye possessing a predominant spectral absorption within the region of the visible spectrum to which said silver halide emulsion is sensitive (initially or after forming the coordination complex), i.e., the blue-sensitive silver halide emulsion layer will have a yellow or yellow-forming dye-releaser associated therewith, the green-sensitive silver halide emulsion layer will have a magenta or magenta-forming dye-releaser associated therewith, and the red-sensitive silver halide emulsion layer will have the cyan or cyan-forming dye-releaser of the invention associated therewith. The dye-releaser associated with each silver halide emulsion layer is contained either in the silver halide emulsion layer itself or in a layer contiguous to the silver halide emulsion layer.

The concentration of the dye-releasing compounds that are employed in the present invention may be varied over a wide range, depending upon the particular compound employed and the results which are desired. For example, the dye-releasers of the present invention may be coated in layers by using coating solutions containing between about 0.5 and about 8 percent by weight of the dye-releaser distributed in a hydrophilic film-forming natural material or synthetic polymer, such as gelatin, polyvinyl alcohol, etc, which is adapted to be permeated by aqueous alkaline processing composition.

A variety of silver halide developing agents or electron transfer agents (ETAs) are useful in this invention. The ETA may also be incorporated in the photosensitive element to be activated by the alkaline processing composition. Specific examples of ETAs useful in this invention include hydroquinone compounds, catechol compounds, and 3-pyrazolidinone compounds as disclosed in column 16 of U.S. Pat. No. 4,358,527, issued Nov. 9, 1982. A combination of different ETAs, such as those disclosed in U.S. Pat. No. 3,039,869, can also be employed. These ETAs are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 3,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye-releasers are dispersed in an aqueous alkaline solution-permeable polymeric binder, such as gelatin, as a separate layer about 0.2 to 7 microns in thickness; and the alkaline solution-permeable polymeric interlayers, e.g, gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a neutralizing material in certain embodiments of film units of this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November 1976 edition of *Research Disclosure,* the disclosure of which is hereby incorporated by reference.

The alkaline solution-permeable, substantially opaque, light-reflective layer employed in certain embodiments of photographic film units used in this invention is described more fully in the November 1976 edition of *Research Disclosure,* page 82, the disclosure of which is hereby incorporated by reference.

The supports for the photographic elements used in this invention can be any material as long as it does not deleteriously affect the photographic properties of the film unit and is dimensionally stable. Typical flexible sheet materials are described on page 85 of the November 1976 edition of *Research Disclosure,* the disclosure of which is hereby incorporated by reference. The supports may be either opaque for obtaining a reflection print or clear or semitranslucent for obtaining a transparency. It transparencies are obtained, they may be viewed through the support side or the opposite side depending upon the "viewing" required.

While the invention has been described with reference to layers of silver halide emulsions and dye image-providing materials, dotwise coating, such as would be obtained using a gravure printing technique, could also be employed. In this technique, small dots of blue-, green-, and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. Pat. No. 4,362,806, issued Dec. 7, 1982.

The silver halide emulsions useful in this invention, both negative-working and direct-positive ones, are well known to those skilled in the art and are described in *Research Disclosure,* Volume 176, December 1978, Item No. 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that, for all practical purposes, do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

Representative compounds within the scope of the invention include the following:

TABLE 1

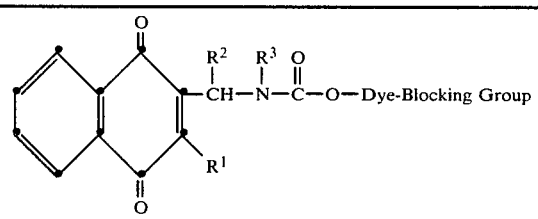

| PRDR Compound | $R^1$ | $R^2$ | $R^3$ | Dye | Blocking Group |
|---|---|---|---|---|---|
| Magenta | | | | | |
| 1 | $C_{15}H_{31}$ | H | $C_6H_5$ | DM1 | none |
| 2 | $C_{15}H_{31}$ | H | $CH_3$ | DM1 | a |
| 3 | $C_{15}H_{31}$ | H | $C_6H_5$ | DM1 | a |
| 4 | $C_{15}H_{31}$ | H | $C_6H_4$—m-$NHSO_2CH_3$ | DM1 | a |
| 5 | $C_{15}H_{31}$ | H | $C_6H_4$—p-Cl | DM1 | a |
| 6* | $C_{16}H_{33}$ | H | $C_6H_5$ | DM2 | none |
| 7* | $C_{16}H_{33}$ | H | $C_6H_4$—p-$NO_2$ | DM3 | none |
| 8 | $C_{16}H_{33}$ | H | $C_6H_4$—p-$NO_2$ | DM4 | none |
| 8A | $C_{16}H_{33}$ | H | $C_6H_4$—m-$NO_2$ | DM4 | b |
| Cyan | | | | | |
| 9 | $C_{15}H_{31}$ | H | $C_6H_5$ | DC1 | a |
| 10 | $C_{15}H_{31}$ | H | $C_6H_5$ | DC2 | a |
| 11* | $C_{16}H_{33}$ | H | $C_6H_4$—p-$NO_2$ | DC3 | none |
| 12* | $C_{16}H_{33}$ | H | $C_6H_4$—m-$NO_2$ | DC4 | none |
| 13 | $C_{15}H_{31}$ | H | $C_6H_5$ | DC2 | c |
| 14 | $C_{16}H_{33}$ | H | $C_6H_4$—m-$NO_2$ | DC5 | b |
| Yellow | | | | | |
| 15 | $C_{15}H_{31}$ | H | $CH_3$ | DY1 | none |
| 16 | $CH_3$ | H | $C_{12}H_{25}$ | DY1 | none |
| 17 | $CH_3$ | H | $C_6H_5$ | DY1 | none |
| 18 | $CH_3$ | $C_6H_4$—p-$C_8H_{17}$ | $C_6H_5$ | DY1 | none |
| 19 | $CH_3$ | H | $C_6H_4$—p-$OC_8H_{17}$ | DY1 | none |
| 20 | $CH_3$ | H | $C_6H_4$—p-$OC_{18}H_{37}$ | DY1 | none |

TABLE 1-continued

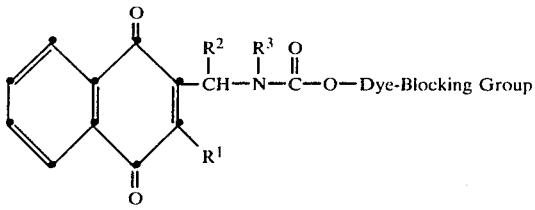

| PRDR Compound | $R^1$ | $R^2$ | $R^3$ | Dye | Blocking Group |
|---|---|---|---|---|---|
| 21 | $CH_3$ | $C_6H_5$ | $C_6H_4$—p-$OC_{18}H_{37}$ | DY1 | none |
| 22 | $C_{15}H_{31}$ | H | $C_6H_5$ | DY2 | a |
| 23 | $C_{15}H_{31}$ | H | $C_6H_4$—m-$NHSO_2CH_3$ | DY2 | a |
| 24 | $C_{15}H_{31}$ | H | $C_6H_5$ | DY1 | none |
| 25* | $C_{15}H_{31}$ | H | $C_6H_5$ | DY3 | none |
| 26* | $C_{16}H_{33}$ | H | $C_6H_4$—m-$NO_2$ | DY3 | none |
| 27 | $C_2H_4OC_{15}H_{33}$ | H | $CH_3$ | DY2 | a |
| 28 | $C_{15}H_{31}$ | $C_6H_5$ | $CH_3$ | DY2 | a |
| 29 | $C_{15}H_{31}$ | $C_6H_4$—p-$CH_3$ | $CH_3$ | DY2 | b |
| 30 | —$C_6H_4$—p-$OC_{16}H_{33}$ | $CH_3$ | $CH_3$ | DY1 | none |
| 31 | t-$C_4H_9$ | H | $C_6H_4$—p-$OC_{18}H_{37}$ | DY1 | none |
| 32 | $CH_2CHC_{10}H_{21}$ | H | $C_6H_4$—p-CN | DY1 | none |
| 33 | $C_{16}H_{33}$ | H | $C_6H_4$—p-$SO_2CH_3$ | DY2 | b |

*These compounds are "chromophore-linked" or "shifted" until imagewise released and do not need a blocking group.

Blocking groups a = 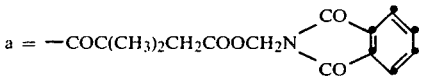

b = 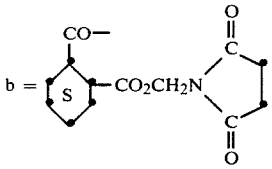

c = 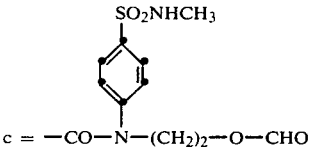

Dye Moieties

DM1 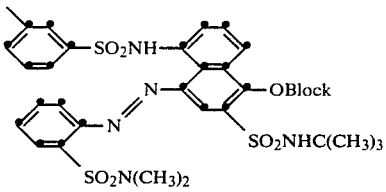

DM2 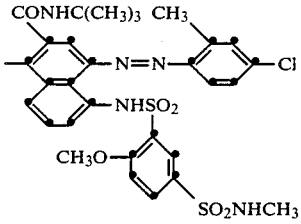

-continued

DM3 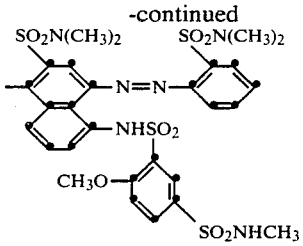

DM4 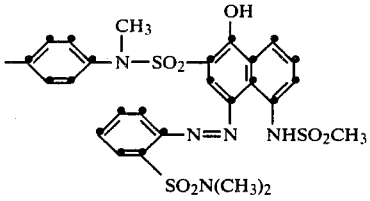

DC1 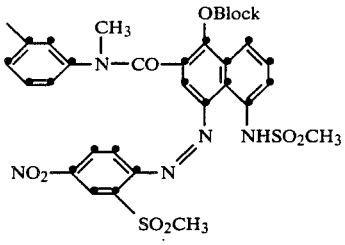

DC2 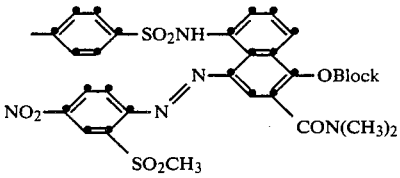

-continued

DC3

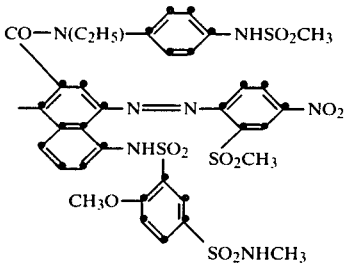

DC4

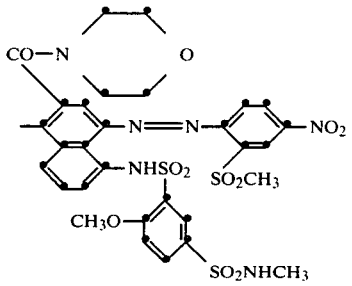

DC5

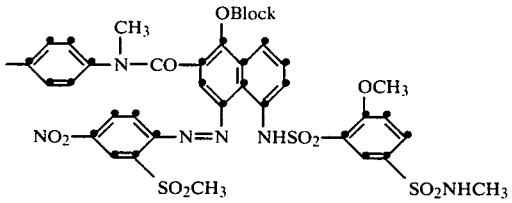

DY1

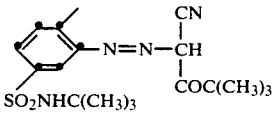

DY2

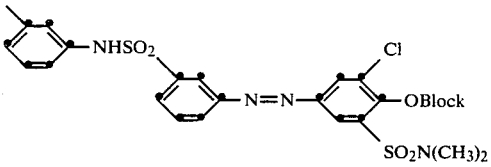

DY3

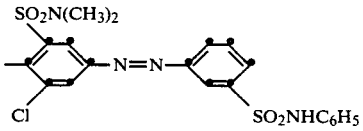

The following examples are provided to further illustrate the invention.

EXAMPLE 1

Preparation of PRDR Compound 1

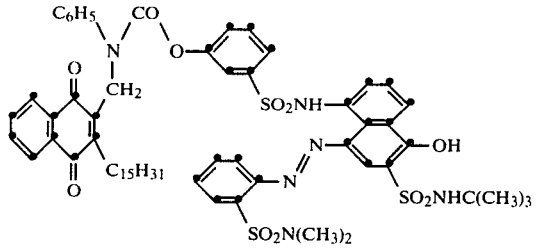

N-Phenyl-N-(3-pentadecyl-1,4-naphthoquinonylmethyl)carbamoyl chloride (9.72 g, 18.1 mmol) was taken up in dry pyridine (70 ml) to which was added the dye A:

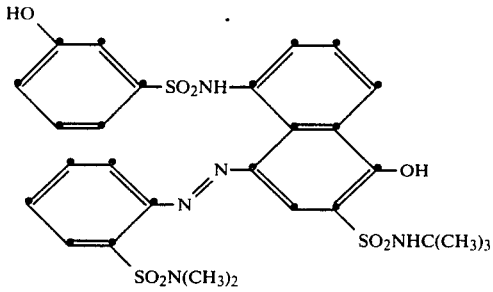

(10.0 g, 15.1 mmol). Diisopropylethylamine (9.5 ml, 54.4 mmol) was added and the mixture was stirred at room temperature for 3 hours. Two volumes of toluene were added and the mixture was concentrated under reduced pressure. The residue was dissolved in ethyl acetate, passed through a short column of silica gel, and washed with ethyl acetate. The eluant was changed to 2 percent methanol in ethyl acetate to collect the product PRDR compound. The collected elutant was concentrated, washed with 2N hydrochloric acid, dried over anhydrous magnesium sulfate, filtered, and concentrated to dryness to give the protonated PRDR. Yield: 14.0 g, (80 percent).

INTERMEDIATES

N-Phenyl-N-(3-pentadecyl-1,4-naphthoquinonylmethyl)carbamoyl chloride

2-Anilinomethyl-3-pentadecyl-1,4-naphthoquinone hydrochloride (9.25 g, 18.1 mmol) was dissolved in dichloromethane (100 ml). A 12 percent solution of phosgene in toluene (45 ml, 54.4 mmol) and diisopropylethylamine (50 ml) were added and the resulting solution was stirred at room temperature for about 15 minutes. The solution was then concentrated under reduced pressure and the residue was taken up in dichloromethane. The solution was washed with 2N hydrochloric acid, dried over anhydrous magnesium sulfate, filtered, and concentrated. The product was used as a crude oil in the preparation of the above PRDR.

2-Anilino-3-pentadecyl-1,4-naphthoquinone hydrochloride

2-Bromomethyl-3-pentadecyl-1,4-naphthoquinone (15 g, 32.5 mmol) was dissolved in tetrahydrofuran (15 ml). Aniline (8.9 ml, 97.5 mmol) was added and the reaction mixture was stirred at room temperature for several hours, or until a thin-layer chromatogram (silica gel, 30 percent ether in hexane) showed essentially no starting material. The solution was then concentrated, dissolved in ethyl acetate, and washed three times with 2N hydrochloric acid. The ethyl acetate solution was dried over anhydrous magnesium sulfate, filtered, and evaporated to near dryness. Th semi-solid was dissolved in a minimum amount of tetrahydrofuran and diluted with acetonitrile (ca. 300 ml). Concentrated hydrochloric acid (10 ml) was then added to crystallize the product which was filtered off, washed well with acetonitrile and air dried. Yield: 13.5 g (81 percent).

2-Bromomethyl-3-pentadecyl-1,4-naphthoquinone

2-Pentadecyl-1,4-naphthoquinone (60 g, 0.163 mol) was suspended in acetic acid (2 l) with stirring. Aqueous 37 percent formaldehyde (200 ml, 2.4 mol) and 31 percent hydrogen bromide in acetic acid (660 ml, 2.4 mol) were added and the mixture was stirred at room temperature overnight. The precipitated product was then filtered off, washed with a minimum amount of acetic acid, water, and was then air dried. Yield: 60 g (80 percent). (Method of R. H. Thomson, J. Chem. Soc., 1953, 1196).

2-Pentadecyl-1,4-naphthoquinone

2-Pentadecyl-1-naphthol (48 , 135 mmol) was dissolved in acetic acid with slight warming. Chromic oxide (55.5 g, 555 mmol) was dissolved in 50 ml water and then 50 ml acetic acid was added. This chromic oxide solution was then added dropwise with stirring to the solution of the pentadecylnaphthol maintaining the temperature between 45°-50° C. The mixture was then stirred for several hours while slowly cooling to room temperature. The pentadecylnaphthoquinone, which had crystallized from solution was filtered off, washed with acetic acid, water, and air dried. Yield: 24 g (48 percent). (Method of L. F. Fieser et al, J. Am. Chem. Soc., 74, 3910 (1952)).

2-Pentadecyl-1-naphthol

A zinc amalgam was prepared by dissolving mercuric chloride (10 g) in 150 ml water and 8 ml concentrated hydrochloric acid, followed by the addition of zinc dust (97.6 g, 149 mmol) with stirring. After 15 minutes the mother liquor was decanted off and the amalgam was washed several times with water followed with ethanol. 2-Pentadecanoyl-1-naphthol (110 g, 298 mmol) was dissolved in ethanol (2 l) with gentle heating. To this mixture was added concentrated hydrochloric acid (500 ml) followed by the freshly prepared amalgam. The resulting mixture was gently refluxed overnight with stirring. Upon cooling of the reaction mixture the product pentadecylnaphthol crystallized and was filtered off. Yield: 100 g (90 percent). (Method of L. F. Fieser et al, J. Am. Chem. Soc., 74, 3910 (1952); ibid. 72, 996 (1950)).

2-Pentadecanoyl-1-naphthol

1-Naphthol (72.1 g, 500 mmol) and pentadecanoic acid (121.2 g, 500 mmol) were mixed with boron trifluoride etherate (400 ml) and heated on a steam bath for 4 hours. Then 400 ml water was carefully added and heating was continued to remove as much of the ether as possible. The precipitated solid was filtered off, washed well with water and air dried. The crude product was recrystallized from ethanol to give the pentadecanoylnaphthol as light yellow plates. Yield: 110 g (60 percent).

EXAMPLE 2

Preparation of PRDR Compound 11, chromophore-linked PRDR in which the dye is shifted by attachment of the naphthoquinone imaging moiety

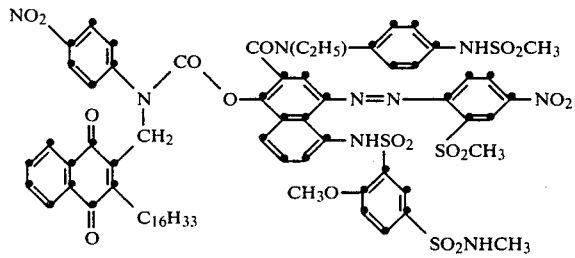

N-4-Nitrophenyl-N-(3-hexadecyl-1,4-naphthoquinonylmethyl)carbamoyl chloride (6.72 g, 11.3 mmol) was dissolved in 10 ml dry pyridine, using a minimum quantity of dichloromethane to aid in dissolution. The dye (as the methylsulfamoyl form)

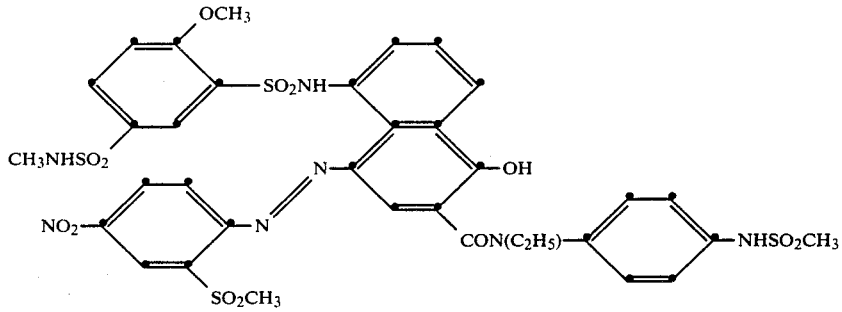

(4.2 g, 4.72 mmol) was then added and the resulting solution was stirred at room temperature overnight. The mixture was then diluted with ethyl acetate, extracted with 2N hydrochloric acid, dried with anhydrous magnesium sulfate, and filtered. The ethyl acetate was removed in vacuo and the residue was dissolved in 20 percent ethyl acetate in toluene. This solution was passed through a short column of silica gel, eluting first with 20 percent ethyl acetate in toluene to remove some impurities, then with 30 percent ethyl acetate in toluene. This second elutant was concentrated under reduced pressure to yield the crude product (60 percent).

INTERMEDIATES

Released Dye:

The sulfonyl fluoride form of the above dye (3.0 g, 3.4 mmol) was suspended in 20 ml tetrahydrofuran and aqueous methylamine (3 ml of 40 percent solution, 38.6 mmol) was then added. The resulting solution was stirred at room temperature for several hours, whereupon a thin layer chromatogram showed no remaining starting material. The mixture was poured into 2N hydrochloric acid with stirring, the product was filtered off, washed with water, and air dried. The dye was obtained in 95 percent yield, 2.9 g.

N-(4-Nitrophenyl)-N-(3-hexadecyl-1,4-naphthoquinonylmethyl)carbamoyl chloride

This compound was prepared by the same method as in Example 1 except that no base, i.e., diisopropylethylamine was necessary. The reaction was completed in about one hour. 2-(4-Nitroanilino)methyl-3-hexadecyl-1,4-naphthoquinone, was prepared as in Example 1 except that it was isolated as the free base rather than as the hydrochloride salt.

EXAMPLE 3

Photographic Imaging Tests (A) Integral imaging receiver (IIR) elements were prepared having the following layers coated on a transparent poly(ethylene terephthalate) support. (Coverages in g/m$^2$ unless specified).

1. Receiving layer of the latex mordant poly(styrene-co-N-vinylbenzyl-N-benzyl-N,N-dimethylammonium sulfate-co-divinylbenzene (2.3) mixed with gelatin (2.3);
2. Reflecting layer of titanium dioxide (19) and gelatin (3.0);
3. Opaque layer of carbon black (1.9) and gelatin (1.2);
4. Green-sensitive, negative-working silver iodobromide emulsion (1.3 Ag), gelatin (2.0), inhibitor (0.25), magenta PRDR compounds 2–7 (0.39 mmol/m$^2$), Incorporated Reducing Agent (IRA) (0.74 mmol/m$^2$), and diethyllauramide (half the weight of the PRDR); and
5. Overcoat layer of gelatin (0.55) hardened with 1.25 percent bis(vinylsulfonyl)methyl ether based on total gelatin.

(B) Additional IIR's were prepared similar to (A) except that layer 4 contained a red-sensitive silver iodobromide emulsion and cyan PRDR compounds 9–12 were employed.

(C) Additional IIR's were prepared similar to (A) except that layer 4 contained a blue-sensitive emulsion, yellow PRDR compounds 15–26 were employed (0.55) and the IRA was present at 1.1 g/m$^2$.

(D) A control IIR was prepared similar to (C) containing the following control PRDR A:

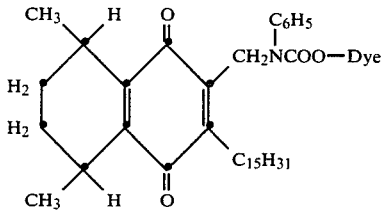

Dye is DY1 of Table 1.

(E) A control IIR was prepared similar to (C) containing control PRDR (B) shown below (a "bis-releaser") (0.25 mmol/m$^2$) and the IRA was present at 0.68 g/m$^2$.

Control PRDR B:

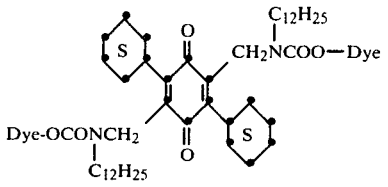

Dye is DY1 of Table 1

IRA:

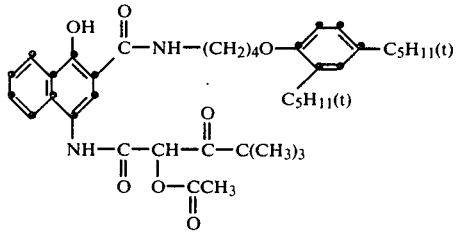

Dispersed in diethyllauramide
Solid:solvent 2:1

Inhibitor:

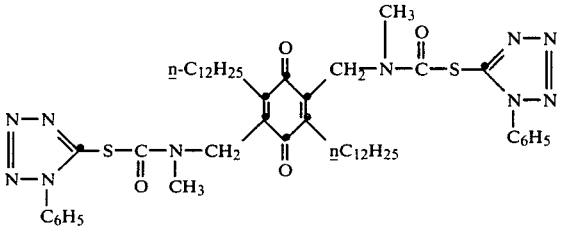

Dispersed in diethyllauramide
Solid:solvent 2:1

Reactivity Test:

Six test samples of each of the above IIR elements were processed without exposure by spreading a viscous processing composition in a pod between the IIR and a clear polyester film sheet using a pair of juxtaposed rollers to provide a fluid gap of 75 μm. The viscous processing composition contained 51 g potassium hydroxide, 57 g carboxymethylcellulose, 10 g ethylenediaminetetracetic acid, di-sodium salt, and 2 g anhydrous sodium sulfite per liter of water. The samples were peeled off from the cover sheet after intervals of 0.5, 1, 3, 5, 10, and 20 minutes. They were buffered at pH 5.5, washed and dried. The Status A density values were read and plotted vs time (minutes). The time required to reach ½ D-max (t-½) and D-max values in Tables 2 and 3 were determined from the time-density plots.

Imaging Test:

Each of the above IIR elements was also exposed through a graduated density test object and processed at 24° C. The processing composition was spread between the IIR and a cover sheet using a pair of juxtaposed rollers to provide a fluid gap of 75 μm. The viscous processing composition contained: 51 g potassium hydroxide, 50 g carboxymethylcellulose, 4.0 g 4-hydroxymethyl-4-methyl-1-p-tolyl-3-pyrazolidinone, 10 g potassium bromide, 2.0 g anhydrous sodium sulfite, 7.9 g ethylenediaminetetracetic acid, disodium salt, and 172 g carbon per liter of water.

The cover sheet comprised a transparent poly(ethylene terephthalate) support bearing the following layers: (1) a neutralizing layer comprising poly(n-butyl acrylate-co-acrylic acid), (30/70 weight ratio) (equivalent to 140 meq. acid/$m^2$); and (2) a timing layer comprising 5.4 g/$m^2$ of a 1:1 physical mixture by weight of poly(acrylonitrile-co-vinylidene chloride-co-acrylic acid latex) (weight ratio of 14/79/7) and a carboxy ester lactone formed by cyclization of a vinyl acetate-maleic anhydride copolymer in the presence of 1-butanol to produce a partial butyl ester with an acid content of 1.1 meq/g.

After three hours the Status A densitometry was measured through the transparent support of the IIR element. The D-max and D-min values are recorded in Tables 2 and 3.

A second sample was exposed and processed as in the imaging test above, except that the processing composition contained 8. g instead of 4. g of the pyrazolidone developing agent and 5. g instead of 10. g of potassium bromide. Within a few hours of processing, the laminate was cut into two parts at the center of the image of the stepped scale and one piece sealed around the edges with a plastic/metal foil-laminated tape and held in a "wet oven" at 60° C. and 70 percent relative humidity for 48 hours. The Status A densitometry was measured on the original and the wet oven stored samples in the same way as described above. The increase in D-min over the D-min of the fresh sample above is the measure of post-process density increase or "shutoff density".

The following results were obtained:

TABLE 2

| IIR | PRDR Compound No. | Reactivity $t_{\frac{1}{2}}$ (sec) | Reactivity D-max | Imaging D-max/D-min | Shutoff Density (D-min Increase) |
|---|---|---|---|---|---|
| (C) | 24 | 46 | 1.9 | 1.8/.15 | .10 |
| (D) | Control PRDR A | 56 | 1.9 | 1.8/.20 | .37 |
| (E) | Control PRDR B | 61 | 1.9 | 1.5/.13 | .15 |

Control PRDR Compound A is structurally related to Compound 24, both compounds having the same $R^1$, $R^2$, $R^3$ and dye moieties, with the only difference being the naphtho group of Compound 24 of the invention, as compared to the benzo group of the control compound. Compound 24 of the invention released dye faster than the benzoquinone analogue, had improved shutoff and a reduction in D-min.

Control PRDR Compound B is also structurally related to Compound 24, both compounds having the same dye moiety. The control compound, however, is a "bis-releaser", which releases two dye moieties from one ballasted quinone compound, as described in columns 35–36 of Chasman et al U.S. Pat. No. 4,139,379. Compound 24 of the invention released dye faster than the bis-releaser analogue, had improved shutoff and an increase in D-max.

The following results were obtained with the other compounds of the invention:

TABLE 3

| IIR | PRDR Compound No. | Reactivity $t_{\frac{1}{2}}$ (sec) | Reactivity D-max | Imaging D-max/D-min | Shutoff Density (D-min Increase) |
|---|---|---|---|---|---|
| (A) | Magenta | | | | |
| | 2 | 89 | 1.9 | 1.6/.14 | .05 |
| | 3 | 75 | 2.1 | 2.0/.14 | .06 |
| | 4 | 44 | 1.7 | 1.9/.86 | .06 |
| | 5 | 72 | 2.0 | 2.1/.14 | .04 |
| | 6 | 182 | 2.1 | 1.0/.15 | .06 |
| | 7 | 52 | 1.2 | 1.4/.16 | .09 |
| (B) | Cyan | | | | |
| | 9 | 55 | 2.3 | 1.9/.16 | .03 |
| | 10 | 47 | 2.3 | 1.9/.18 | .04 |
| | 11 | 53 | 1.4 | 1.0/.19 | .48 |
| | 12 | 40 | 1.4 | 0.76/.18 | — |
| (C) | yellow | | | | |
| | 15 | 46 | 1.8 | 1.7/.51 | .06 |
| | 16 | 42 | 1.8 | 1.2/.88 | .37 |
| | 17 | 51 | 1.8 | 1.6/.59 | .41 |
| | 18 | 37 | 1.8 | 1.7/.20 | .25 |
| | 19 | 47 | 1.8 | 1.5/.38 | .14 |
| | 20 | 35 | 1.9 | 1.8/.85 | .28 |
| | 21 | 38 | 1.9 | 1.8/.27 | .25 |
| | 22 | 22 | 2.1 | 2.1/.18 | .05 |
| | 23 | 24 | 2.1 | 2.1/.29 | .04 |
| | 25 | 115 | 1.9 | 1.1/.16 | .07 |
| | 26 | 47 | 1.6 | 1.5/.11 | .04 |

The above results indicate high reactivity, good imaging values and good shutoff for the compounds of the invention.

EXAMPLE 4

Photographic Imaging Tests

The procedure of Example 3 was repeated with Compounds 22, 3, 10 and 13 and bis-releaser analogues (releasing the same dye moiety) Control PRDR Compounds C, D, E and F. The following results were obtained:

TABLE 4

| PRDR Compound No. | Reactivity $t_{\frac{1}{2}}$ (sec) | Reactivity D-max | Imaging D-max/D-min | Shutoff Density (D-min Increase) |
|---|---|---|---|---|
| 22 | 38 | 2.1 | 2.1/0.19 | 0.07 |
| Control Compound C | 87 | 2.2 | 1.0/0.22 | nd |
| 3 | 75 | 2.0 | 2.0/0.14 | 0.05 |
| Control Compound D | 94 | 2.2 | 1.9/0.14 | 0.13 |
| 10 | 47 | 2.3 | 1.9/0.18 | 0.04 |
| Control Compound E | 54 | 2.4 | 2.2/0.18 | 0.22 |
| 13 | 76 | 2.2 | 2.0/0.20 | 0.06 |
| Control Compound F | 63 | 2.3 | 2.3/0.35 | 0.27 |

nd = not determined

The above results again illustrate that the compounds of the invention as compared to the bis-releaser analogues have improved shutoff, improved D-min's, improved or approximately the same D-max's, and generally improved reactivities.

Control PRDR Compound C

-continued

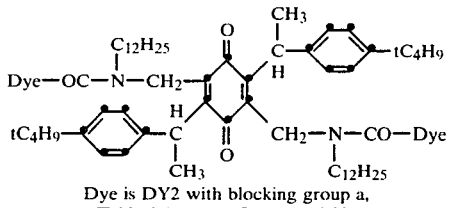

Dye is DY2 with blocking group a, Table 1 (same as Compound 22)

Control PRDR Compound D

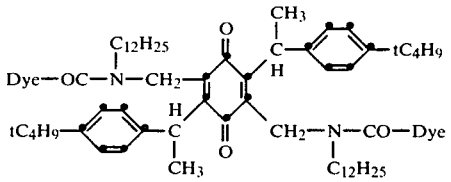

Dye is DM1 with blocking group a, Table 1 (same as Compound 3)

Control PRDR Compound E

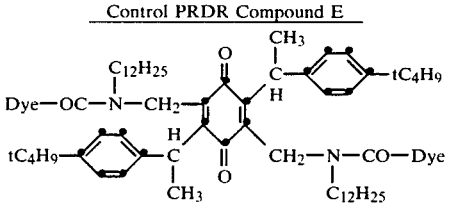

Dye is DC2 with blocking group a, Table 1 (same as Compound 10)

Control PRDR Compound F

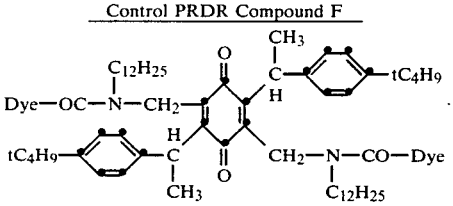

Dye is DC2 with blocking group c, Table 1 (same as Compound 13)

The invention has been described in detail with particular reference to preferred embodiments thereof, but it will be understood that variations and modifications can be effected within the spirit and scope of the invention.

What is claimed is:

1. In a photographic element comprising a support having thereon at least one photosensitive silver halide emulsion layer, said emulsion layer having associated therewith a nondiffusible, positive-working, redox dye-releaser compound capable of releasing at least one diffusible dye moiety, the improvement wherein said compound has the formula:

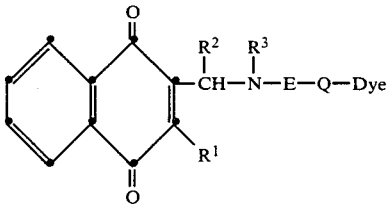

wherein:

(a) $R^1$ represents a substituted or unsubstituted alkyl group of from 1 to about 30 carbon atoms or a substituted or unsubstituted aryl group of from 6 to about 12 carbon atoms, (b) $R^2$ and $R^3$ each independently represents hydrogen or $R^1$;

(c) E represents carbonyl or thiocarbonyl;

(d) Q represents a nonmetallic atom of Group VA or VIA of the periodic table in its minus 2 or minus 3 valence state; and (e) Dye represents a diffusible dye moiety or precursor thereof;

with the proviso that at least one of $R^1$, $R^2$ and $R^3$ is an organic ballasting radical of such molecular size and configuration as to render said compound nondiffusible in said photographic element during development in an alkaline processing composition.

2. The photographic element of claim 1 wherein $R^1$ is said ballasting radical and $R^3$ is aryl.

3. The photographic element of claim 2 wherein $R^1$ is a substituted or unsubstituted alkyl group of at least about 12 carbon atoms and $R^3$ is phenyl.

4. The photographic element of claim 1 wherein Q is nitrogen, oxygen, sulfur or selenium.

5. The photographic element of claim 1 wherein Q is oxygen.

6. The photographic element of claim 1 where $R^2$ is hydrogen and E is carbonyl.

7. The photographic element of claim 1 wherein $R^1$ is said ballasting radical and comprises a substituted or unsubstituted alkyl group of at least about 12 carbon atoms, $R^2$ is hydrogen, $R^3$ is phenyl, E is carbonyl and Q is oxygen.

8. The photographic element of claim 1 wherein Dye represents an azo dye moiety.

9. The photographic element of claim 1 wherein said silver halide emulsion is negative-working and said element contains an incorporated reducing agent.

10. The photographic element of claim 1 wherein said support has thereon a dye image-receiving layer, an opaque reflecting layer, an opaque absorbing layer, and negative-working, red-, green-, and blue-sensitive silver halide emulsion layers having associated therewith, respectively, cyan, magenta and yellow positive-working, redox dye-releasers.

11. The photographic element of claim 1 wherein said compound is

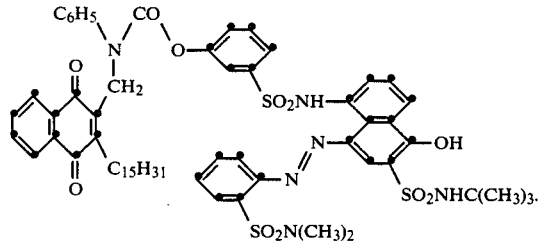

12. The photographic element of claim 1 wherein said compound is

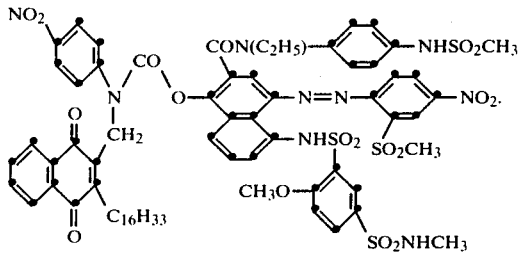

13. In a photographic assemblage to be processed with an alkaline processing composition comprising:

(a) a photographic element comprising a support having thereon at least one photosensitive silver halide emulsion layer having associated therewith a nondiffusible, positive-working, redox dye-releaser capable of releasing at least one diffusible dye moiety; and (b) a dye image-receiving layer; the improvement wherein said compound has the formula:

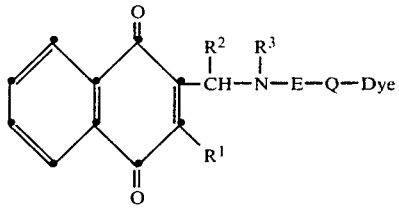

wherein:

(a) $R^1$ represents a substituted or unsubstituted alkyl group of from 1 to about 30 carbon atoms or a substituted or unsubstituted aryl group of from 6 to about 12 carbon atoms;

(b) $R^2$ and $R^3$ each independently represents hydrogen or $R^1$;

(c) E represents carbonyl or thiocarbonyl;

(d) Q represents a nonmetallic atom of Group VA or VIA of the periodic table in its minus 2 or minus 3 valence state; and (e) Dye represents a diffusible dye moiety or precursor thereof;

with the proviso that at least one of $R^1$, $R^2$ and $R^3$ is an organic ballasting radical of such molecular size and configuration as to render said compound nondiffusible in said photographic element during development in an alkaline processing composition.

14. The assemblage of claim 13 which also contains an alkaline processing composition and means containing same for discharge within said assemblage.

15. The assemblage of claim 14 wherein $R^1$ is said ballasting radical and $R^3$ is aryl.

16. The assemblage of claim 15 wherein $R^1$ is a substituted or unsubstituted alkyl group of at least about 12 carbon atoms and $R^3$ is phenyl.

17. The assemblage of claim 14 wherein $R^1$ is said ballasting radical and comprises a substituted or unsubstituted alkyl group of at least about 12 carbon atoms, $R^2$ is hydrogen, $R^3$ is phenyl, E is carbonyl and Q is oxygen.

18. The assemblage of claim 14 wherein Dye represents an azo dye moiety.

19. The assemblage of claim 14 wherein said dye image-receiving layer is located between said support and said silver halide emulsion layer.

20. The assemblage of claim 19 where a stripping layer is located between said dye image-receiving layer and said silver halide emulsion layer.

21. The assemblage of claim 20 which also contains a transparent cover sheet which is coated with, in sequence, a neutralizing layer and a timing layer.

22. The assemblage of claim 21 wherein said discharging means is a rupturable container containing said alkaline processing composition and an opacifying agent, said container being so positioned during processing of said assemblage that a compressive force applied to said container will effect a discharge of the container's contents between said cover sheet and the layer outermost from said support.

23. The assemblage of claim 14 wherein said support having thereon said silver halide emulsion layer is opaque, and said dye image-receiving layer is located on a separate dye image-receiving element.

24. The assemblage of claim 23 wherein said dye image-receiving element has thereon, in sequence, a neutralizing layer, a timing layer, and said dye image-receiving layer.

25. The assemblage of claim 23 wherein said opaque support has thereon, in sequence, a neutralizing layer, a timing layer and said silver halide emulsion layer.

26. In an integral photographic assemblage comprising:

(a) a photographic element comprising a transparent support having thereon the following layers in sequence: a dye image-receiving layer; a stripping layer, an alkaline solution-permeable, light-reflective layer; an alkaline solution-permeable, opaque absorbing layer; a red-sensitive, negative-working, silver halide emulsion layer having a nondiffusible, positive-working, cyan redox dye-releaser compound associated therewith; a green-sensitive, negative-working, silver halide emulsion layer having a nondiffusible, positive-working, magenta redox dye-releaser compound associated therewith; and a blue-sensitive, negative-working, silver halide emulsion layer having a nondiffusible, positive-working, yellow redox dye-releaser compound, associated therewith;

(b) a transparent cover sheet superposed over said blue-sensitive silver halide emulsion layer and comprising a transparent support coated with, in sequence, a neutralizing layer and a timing layer; and (c) a rupturable container containing an alkaline processing composition including an electron transfer agent and an opacifying agent, said container being so positioned during processing of said assemblage that a compressive force applied to said container will effect a discharge of the container's contents between said transparent sheet and said blue-sensitive silver halide emulsion layer;

the improvement wherein each said compound has the formula:

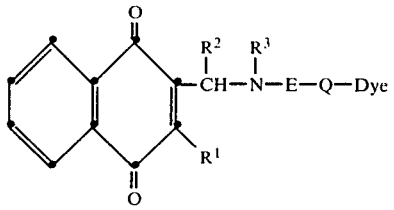

wherein:

(a) $R^1$ represents a substituted or unsubstituted alkyl group of from 1 ; to about 30 carbon atoms or a substituted or unsubstituted aryl group of from 6 to about 12 carbon atoms, (b) $R^2$ and $R^3$ each independently represents hydrogen or $R^1$;

(c) E represents carbonyl or thiocarbonyl;

(d) Q represents a nonmetallic atom of Group VA or VIA of the periodic table in its minus 2 or minus 3 valence state; and (e) Dye represents a diffusible dye moiety or precursor thereof;

with the proviso that at least one of $R^1$, $R^2$ and $R^3$ is an organic ballasting radical of such molecular size and configuration as to render said compound nondiffusible in said photographic element during development in an alkaline processing composition.

* * * * *